US006795011B1

(12) United States Patent
Berthoud et al.

(10) Patent No.: US 6,795,011 B1
(45) Date of Patent: Sep. 21, 2004

(54) REMOTE CONTROL HELP FEATURE

(75) Inventors: Charles William Berthoud, Bethlehem, PA (US); Lakshmi Narayana Jampanaboyana, Allentown, PA (US); Mohd Majed Hobbi, Allentown, PA (US)

(73) Assignee: Agere Systems Inc., Allentown, PA (US)

( * ) Notice: Subject to any disclaimer, the term of this patent is extended or adjusted under 35 U.S.C. 154(b) by 268 days.

(21) Appl. No.: 09/699,633

(22) Filed: Oct. 31, 2000

(51) Int. Cl.[7] ..... G08C 19/12

(52) U.S. Cl. ..... 341/173; 341/176; 708/145; 345/705

(58) Field of Search ..... 341/173, 176, 341/21, 23; 340/825.19; 709/145; 434/112, 116; 345/705; 709/271

(56) References Cited

U.S. PATENT DOCUMENTS 4,853,888 A * 8/1989 Lata et al. ..... 345/172
4,885,580 A * 12/1989 Noto et al. ..... 341/23
5,007,008 A * 4/1991 Beers ..... 708/145
5,258,748 A * 11/1993 Jones ..... 345/172
5,450,079 A 9/1995 Dunaway ..... 341/23
5,488,427 A 1/1996 Kayashima et al. ..... 348/569
5,500,691 A * 3/1996 Martin et al. ..... 348/734
5,594,673 A * 1/1997 Coffin ..... 708/145
5,936,611 A 8/1999 Yoshida ..... 345/158
6,094,239 A * 7/2000 Weber ..... 348/734

* cited by examiner

*Primary Examiner*—Albert K. Wong

(57) ABSTRACT

In accordance with the principles of the present invention, a remote control device includes a HELP feature which is driven by the activation of the button in question itself. In particular, if a multiple-use button is pressed quickly (i.e., for less than a given duration), or in another embodiment if held for a long time (i.e., for more than another given duration), then the HELP mode is triggered for that key. The help may be spoken and/or displayed from either the remote control device itself, or from the controlled device.

19 Claims, 5 Drawing Sheets

*FIG. 3*

| KEY | FUNCTION/ MODE | STORED SPEECH PHRASE | |
|---|---|---|---|
| CH + | A (VCR) | "INCREASE CHANNEL" | 302 |
| CH + | B (TV) | "INCREASE SIZE OF PIP" | 304 |
| CH + | C (DVD) | "INCREASE TRACK" | 306 |
| CH − | A | "DECREASE CHANNEL" | 308 |
| CH − | B | "DECREASE SIZE OF PIP" | 310 |
| CH − | C | "DECREASE TRACK" | 312 |
| 1 | A | "ONE" | 314 |
| 1 | B | "ONE" | 316 |
| 1 | C | "TRACK ONE" | 318 |
| | | | |

400

REMOTE CONTROL HELP FEATURE

BACKGROUND OF THE INVENTION

1. Field of the Invention

This invention relates generally to wireless remote controls. more particularly, it relates to the addition of a help feature in a device utilizing a wireless remote control.

2. Background

Wireless remote controls for consumer devices, particularly entertainment devices, have become common and almost essential. Wireless remote controls typically include an infrared LED device which communicates in a single direction toward a photodetector of the consumer device. The LED of the remote control is turned on and off in rapid succession to transmit digital information to the consumer device relating to which button has been activated on the remote control.

Infrared LEDs are the most common communication means, particularly because the infrared wavelength is invisible to the human eye, but requires line-of-sight between the remote control and the photodetector of the consumer device. Of course, some remote controls utilize radio frequency (RF) communication, which eliminates the line-of-sight requirements of infrared devices, and typically allows a greater range between the remote control device and the consumer device.

Initially, remote control devices had few buttons (e.g., POWER, CHAN. UP, CHAN. DOWN, VOLUME UP, and VOLUME DOWN). However, as the usefulness of remote control devices grew over time, additional features were included in the remote control devices, increasing the button count on the remote control and the overall size of the remote control device.

To reduce the size of the remote control, buttons are typically made smaller. However, there is a limit as to how small and tightly packed buttons on a remote control can be packed before the remote control device becomes uncomfortable to use. Thus, the use of a single button for multiple purposes has grown in popularity.

To use a single button for multiple purposes in a remote control, a function key may be selected contemporaneous with the single button to define which of the multiple uses the activation relates to. Alternatively, a mode may be set on the remote control such that until the mode is changed again, the single button will have the function assigned under the selected mode. For instance, many television remote controls have the ability to also control a VCR and/or a DVD player. Many of these multiple device remote controls have mode buttons to select "TV", "VCR" or "DVD".

The manufacturer typically includes a lengthy instruction manual to inform the user as to the particular function of a particular key under a particular mode. Each user of the remote control should learn the features of their particular remote control, so it is often necessary to keep the instruction manual handy in the event that a new user (e.g., another family member) may learn the various functions of each button of the relevant remote control.

Remote controls also include printed legends near each button to remind the user as to what the particular purposes of each button are under each mode or function. However, the printed legends require space and increase the overall size of the remote control, somewhat defeating the purpose of multiple function buttons. Moreover, the printed legends are often very cryptic, not fully lending themselves to self-explanation to a new user.

As can be appreciated, the more buttons and the more features implemented on a remote control, the more information a user must remember. This becomes exacerbated by the proliferation of remote controls for various consumer items in a typical home.

There have been prior attempts to add help features to remote control devices. For instance, U.S. Pat. No. 5,936,611 to Yoshida ("Yoshida") discloses the use of an on-screen display which shows the keypad of the remote control in a help mode when a dedicated MENU button is pressed. In the help mode, when the user presses an arbitrary multiple-use button on the remote control, the displayed button corresponding to the actually pressed button changes color or blinks on the screen of the consumer device, together with a functional description of the activated button.

U.S. Pat. No. 5,488,427 to Kayashima et al. ("Kayashima") discloses a displayed menu including a guide to help one use a remote control device for a television system including a TV, VCR, CD player, tape deck and radio tuner. By pressing a dedicated HELP button, an image of the remote control is shown on the screen and an explanation of operation is displayed on the screen to help the user.

U.S. Pat. No. 5,450,079 to Dunaway ("Dunaway") discloses a remote control which has graphics associated with each button which are changed when a HELP mode is selected. Selected menus and textual help messages may be loaded into the remote control device for display at the remote control device.

The use of a dedicated HELP button requires special attention by the user of the remote control device in locating the HELP button, activating the HELP button. Unfortunately, this requires extra button presses, and presumes that a new user understands the function of the HELP button itself.

There is a need for a simplified method and apparatus to simplify the features of multiple-use buttons on a wireless remote control device.

SUMMARY OF THE INVENTION

In accordance with the principles of the present invention, a wireless remote control device comprises a plurality of buttons, and remote control functional circuitry adapted to provide wireless communication to a controlled device relating to an activated one of the plurality of buttons. A help mode activator module allows operation of a function otherwise designated by activation of the activated one of the plurality of buttons if the activation is not a flash or an extended activation.

A method of providing help to a user of a remote control device based solely on activation of a relevant button in accordance with another aspect of the present invention comprises flashing a button of the remote control device, and presenting help information relating to the button to the user based on the flash activation of the button.

BRIEF DESCRIPTION OF THE DRAWINGS

Features and advantages of the present invention will become apparent to those skilled in the art from the following description with reference to the drawings, in which:

FIG. 3 shows exemplary entries in a digitized help phrases database shown in FIG. 2.

DETAILED DESCRIPTION OF ILLUSTRATIVE EMBODIMENTS

In accordance with the principles of the present invention, a remote control device includes a HELP feature which is driven by the activation of the button in question itself. In particular, if a multiple-use button is pressed quickly (i.e., for less than a given duration), or in another embodiment if held for a long time (i.e., for more than another given duration), then the HELP mode is triggered for that key. The help may be spoken and/or displayed.

Figure 1:
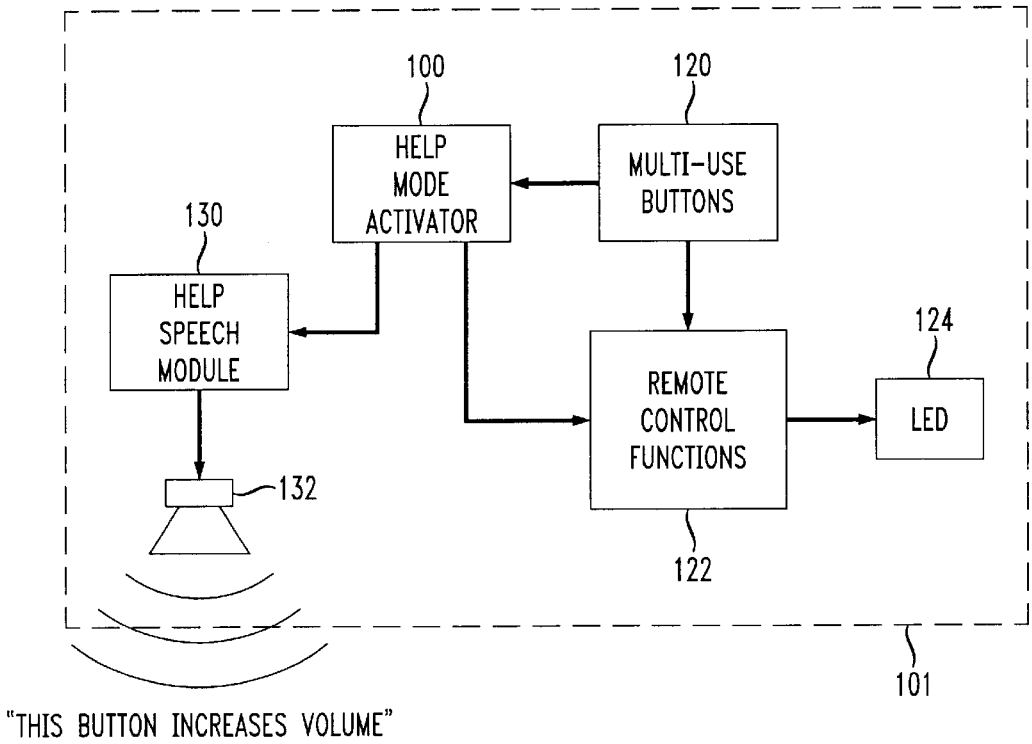
FIG. 1 shows a remote control device including a speaking help mode for multi-function buttons, in accordance with the principles of the present invention.

FIG. 1 shows a remote control device including a speaking help mode for multi-function buttons, in accordance with the principles of the present invention.

In particular, as shown in FIG. 1, a remote control device 101 includes conventional remote control functions 122 and an LED 124 for communicating with the controlled device, and multi-use buttons 120 on the face of the remote control device 101. However, in accordance with the principles of the present invention, the remote control device 101 further includes a help mode activator 100, help speech module 130, and speaker 132.

The remote control functions 122 shown in FIG. 1 depicts the conventional circuitry necessary to decipher the button pressed, and to drive the LED 124 with the information necessary to indicate to the controlled device which button has been activated.

The multi-use buttons 120 are also monitored by the help mode activator 100. The help mode activator 100 determines if the activation of the button in question is a request for help relating to that particular button. For instance, the help mode activator 100 may determine if the depression of the particular multi-use button was a flash (e.g., less than, say, 50 milliseconds) indicating a request for help information. Alternatively, the help mode activator 100 may determine if the depression of the particular multi-use button was an extended activation (e.g., held activated for more than, say, 1 second) indicating a request for help information. Of course, other time limits may be set for a flash and/or extended activation within the scope of the present invention.

If a request for help information is detected, the help mode activator 100 indicates to the remote control functions that the button activation was not requesting performance of the designated feature but rather is a request for help information relating to the current mode or designated feature of the activated button. This help request may be passed on to the controlled device through the wireless interface for appropriate display/audio help information presented to the user via the display/speaker of the controlled device (e.g., TV).

Figure 2:
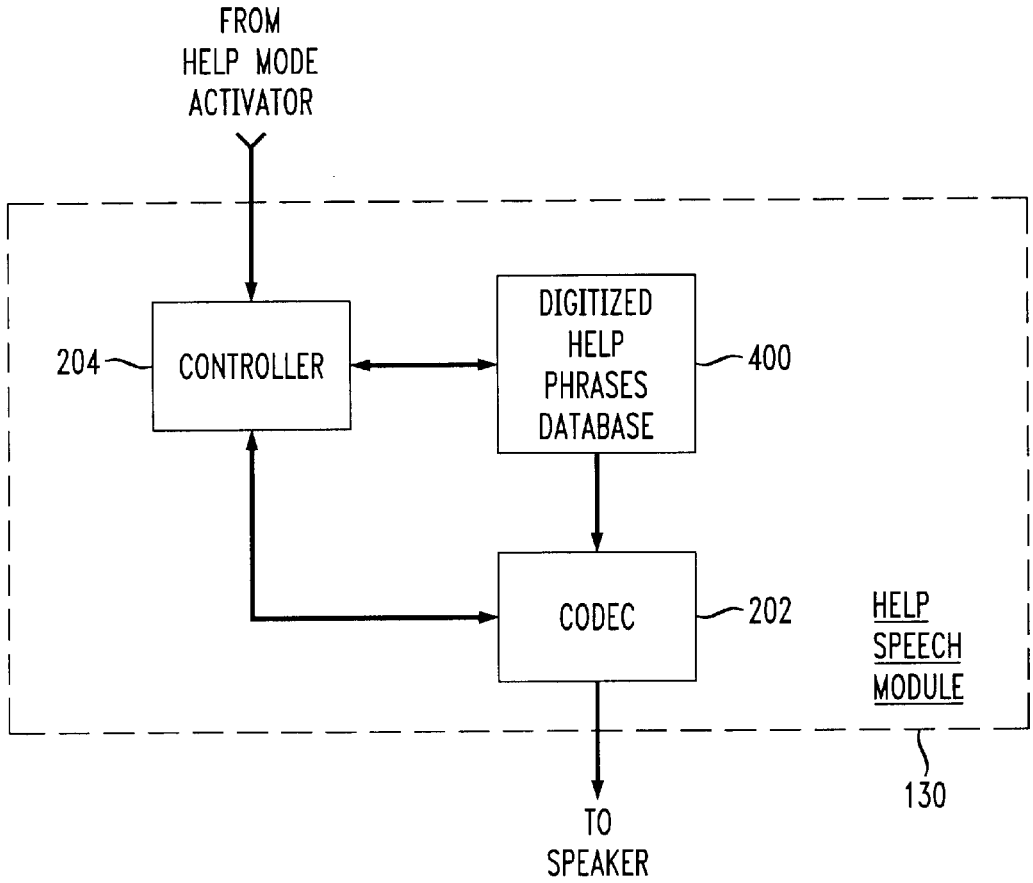
FIG. 2 is a detailed block diagram of the help speech module shown in FIG. 1.

Alternatively, as shown in FIG. 1, the spoken help may be presented to the user from the remote control device 101 itself via the optional help speech module 130 and optional speaker 132. FIG. 2 is a detailed block diagram of the help speech module 130 shown in FIG. 1.

In particular, as shown in FIG. 2, the help speech module 130 includes a controller 204, a digitized help phrases database 400, and a codec 202.

The controller 204 may be any suitable processing or controller device, e.g., a microcontroller, a microprocessor, a digital signal processor, or an ASIC logic device. The controller 204 receives as input an indication as to which multi-use button was flashed from the help mode activator 100, as well as the currently selected mode or previously selected function key.

The codec 202 may simply be a digital to analog converter, but preferably includes compression decoding to allow compressed digitized storage of the help phrases in the digitized help phrases database 400. The codec 202 outputs an analog signal for appropriate amplification and output by the speaker 132.

In response to the receipt of a flashed multi-use button, the controller 204 searches a digitized help phrases database 400 for an appropriate help phrase corresponding to that buttons designated feature, retrieves the digitized speech or synthesized speech relating to that help phrase, and outputs the digitized help phrase to the codec 202.

FIG. 3 shows exemplary entries in an exemplary digitized help phrases database 400 as shown in FIG. 2.

In particular, as shown in FIG. 3, the digitized help phrases database 400 associates particular multi-use keys (shown as symbols in FIG. 3 but in reality represented by a numeric representation of the particular multi-use key) with stored speech phrases. Each multi-use key may have multiple help phrases selected depending upon the current mode or selected function of the remote control device 101.

For instance, as shown in entry 302, the currently selected mode is "A", designated as operating, e.g., a VCR. In this mode, when the "CH+" button is flashed, the help phrase "increase channel" will be retrieved for output either at the remote control or at the controlled device. As shown in entry 308, when the "CH−" button is flashed while in mode A, the phrase "decrease channel" will be retrieved by the controller 204 from the digitized help phrases database 400. If the "1" button is flashed, the help phrase "one" will be spoken either from the speaker 132 at the remote control device 101 or from the controlled device.

Similarly, as shown in entries 304, 310 and 316 of FIG. 3, if the selected mode is "B" designated as operating as TV, the spoken phrase for a flash of the "CH+" key will be "increase size of picture-in-picture" instead of the "increase channel" as was retrieved and spoken when the mode of the remote control device was "A". A flash (or extended activation) of button "CH−" will cause the output of "decrease size of picture-in-picture" in mode "B", while a flash of button "1" in this mode will cause the output of "one".

If the remote control device 101 has additional modes, additional phrases may be included for those modes of the multi-use buttons as well. For instance, as shown in entries 306, 312 and 318 of FIG. 3, control of, e.g., a digital video disk (DVD) player may be implemented with the help phrases for a mode "C" of, e.g., "increase track" (button "CH+"), "decrease track" (button "CH−"), "track one" (button "1"), etc.

The embodiment of FIG. 1 shows an infrared (IR) communication interface between the remote control device 101 and the controlled device. While having particular relevance and advantage in IR remote control devices for consumer entertainment devices such as a TV, the principles of the present invention relate equally to the implementation of a help feature instigated by activation of the relevant multi-use button itself without having to first change a mode or activate a function selection key in RF wireless devices (e.g., using a piconet such as BLUETOOTH™ communication interface to the controlled device).

Moreover, the embodiment of FIG. 1 implements and outputs the help speech phrases within the remote control device 101 itself. However, it is within the principles of the present invention to direct the controlled device to output the help phrases through communications over the IR or RF wireless interface.

Figure 4:
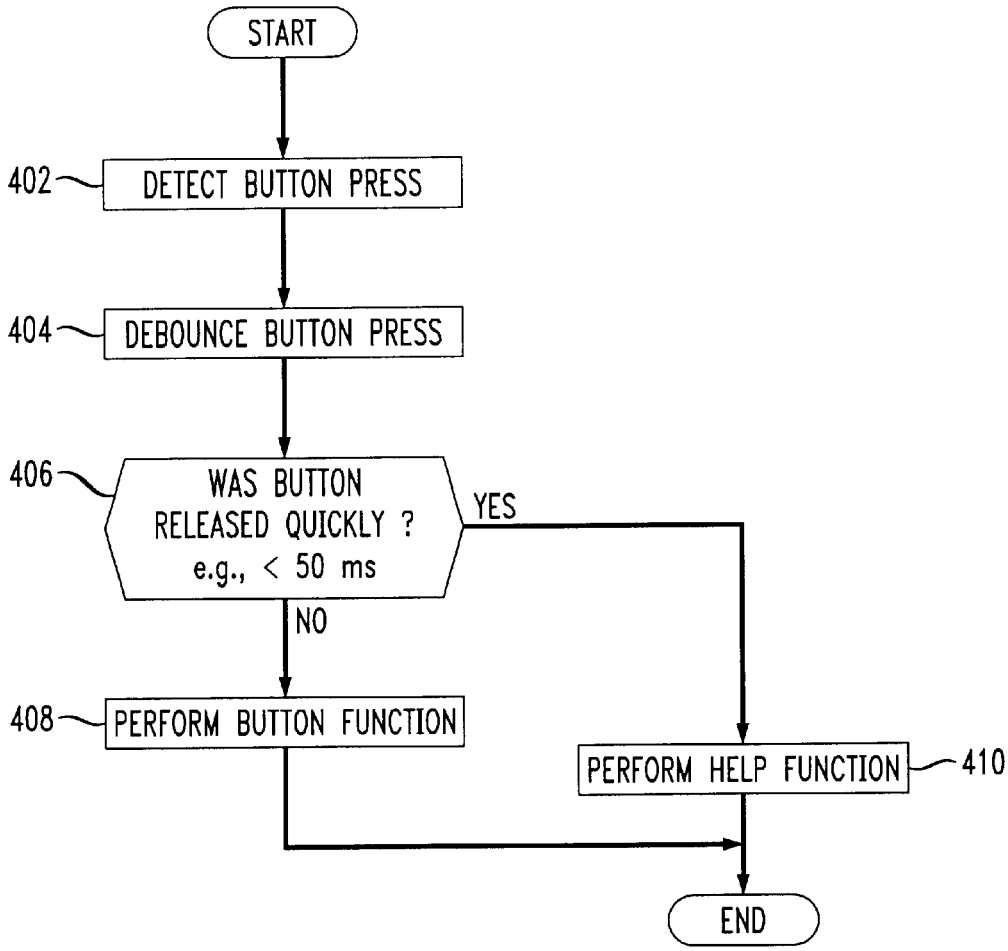
FIG. 4 is an exemplary flow chart showing activation of the help mode using a quick flash of the relevant multi-purpose button in question itself, in accordance with the principles of the present invention.

FIG. 4 is an exemplary flow chart showing activation of the help mode using a quick flash of the relevant multi-purpose button in question itself, in accordance with the principles of the present invention.

In particular, as shown in step 402 of FIG. 4, an activation of particular multi-use button is detected.

In step 404, the activation of the button is debounced in any conventional manner.

In step 406, it is determined whether or not the activated button was flashed (e.g., activated or depressed for less than a redetermined amount of time, e.e.g., for less than 50 ms).

If the activated multi-use button was not flashed, the otherwise conventional function designated by the activated button is processed (e.g., the identity of the button is transmitted to the controlled device via the wireless interface), as shown in step 408.

However, if the activated multi-use button was flashed, the otherwise conventional function of the multi-use button is not performed. Instead, a help request for that particular multi-use button is generated and acted on either by speech output by the remote control itself, or by communication to the controlled device via the wireless interface for spoken or displayed help relating to the current mode of the remote control device 101 and the flashed multi-use button by the controlled device, as shown in step 410.

Figure 5:
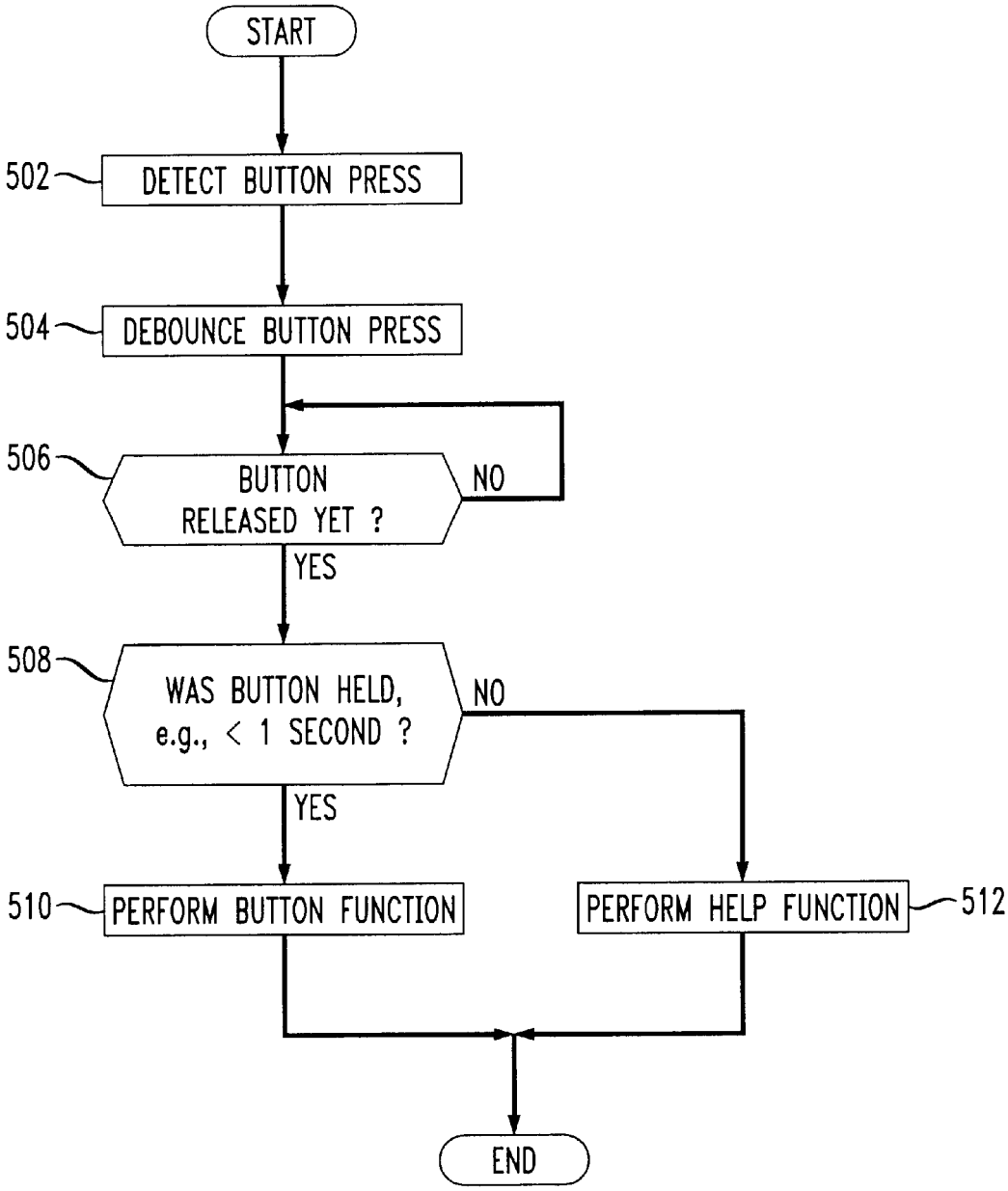
FIG. 5 is an exemplary flow chart showing activation of the help mode using an extended activation of the relevant multi-purpose button in question itself, in accordance with the principles of the present invention.

FIG. 5 is an exemplary flow chart showing activation of the help mode using an extended activation of the relevant multi-purpose button in question itself, in accordance with the principles of the present invention.

In particular, as shown in step 502 of FIG. 5, activation of a particular multi-use button is detected, and the activation is debounced as shown in step 504 to provide robustness to the remote control device and ensure intended activation of the multi-use button.

In step 506, it is determined whether or not the particular multi-use button has yet been released. If not, the process loops until the multi-use button is released.

In step 508, once the activated multi-use button has finally been released, it is determined whether or not the button was activated for greater than a predetermined amount of time, e.g., for greater than 1 second. If so, it is determined to be an 'extended' activation of the relevant multi-use button, generating a help request for that particular button instead of performing the feature otherwise indicated by activation of that multi-use button.

If the activation of the relevant multi-use button was extended, then the help function for that multi-use button in its current mode is generated and output to the user, as shown in step 512. If the button activation was not extended, then the otherwise conventional operation designated by the activated multi-use button is performed, as shown in step 510.

After activation of a spoken help phrase, the remote control device 101 may return to otherwise normal operation. In the case of displayed help relating to the activated multi-use button, the help display may be terminated after a given amount of time (e.g., after 10 seconds) or until another button on the remote control device 101 is activated, whichever happens first.

Accordingly, an unfamiliar user to a remote control device can easily navigate through the control buttons of even a complicated and multi-layered use of multi-use buttons with relative ease, without the need to 'experiment' by activating button after button and risking the inability to navigate the controlled device back to the condition and mode it was in before the new user took control of the unfamiliar remote control device.

While the invention has been described with reference to the exemplary embodiments thereof, those skilled in the art will be able to make various modifications to the described embodiments of the invention without departing from the true spirit and scope of the invention.

What is claimed is:

1. A wireless remote control device, comprising:

a plurality of multi-use buttons, said plurality of multi-use buttons having a single closure position;

remote control functional circuitry adapted to provide wireless communication to a controlled device relating to an activated one of said plurality of multi-use buttons; and a help mode activator module adapted to assist a user in using at least one of said plurality of multi-use buttons and prevent operation of a function associated with said wireless remote control device otherwise designated by activation of said activated one of said plurality of buttons if said activation is one of a flash and an extended activation.

2. The wireless remote control device according to claim 1, wherein:

said plurality of multi-use buttons each correspond to a plurality of respective functions.

3. The wireless remote control device according to claim 1, wherein:

said help mode activator module is further adapted to allow operation of said function otherwise designated by activation of said activated one of said plurality of multi-use buttons if said activation is neither said flash nor said extended activation.

4. The wireless remote control device according to claim 1, wherein:

said remote control device is an infrared wireless device.

5. The wireless remote control device according to claim 1, wherein:

said remote control device is an RF wireless device.

6. The wireless remote control device according to claim 1, further comprising:

a help speech module; and a speaker.

7. The wireless remote control device according to claim 6, wherein said help speech module comprises:

a digitized help phrases database; and a codec.

8. The wireless remote control device according to claim 1, wherein:

said flash is an activation of less than 50 ms.

9. The wireless remote control device according to claim 1, wherein:

said extended activation is an activation in excess of 1 second.

10. A method of providing help information to a user of a remote control device based solely on activation of a relevant multi-use button, comprising:

flash activating a multi-use button of said remote control device said multi-use button having a single closure position; and presenting help information relating to said multi-use button of said remote control device to said user based on said flash activation of said multi-use button to assist said user in using said multi-use button.

11. The method of providing help information to a user of a remote control device based solely on activation of a relevant button according to claim 10, wherein:

said multi-use button corresponds to any one of a plurality of commands at any particular time.

12. The method of providing help information to a user of a remote control device based solely on activation of a relevant button according to claim 10, further comprising:

selecting one of a plurality of help phrases for said multi-use button based on a current mode of said remote control device.

13. The method of providing help information to a user of a remote control device based solely on activation of a relevant button according to claim 10, wherein:

said help information is a spoken phrase.

14. The method of providing help information to a user of a remote control device based solely on activation of a relevant button according to claim 10, wherein:

said help information is displayed at a device controlled by said remote control device.

15. Apparatus for providing help information to a user of a remote control device based solely on activation of a relevant button, comprising:

means to allow flashing of a multi-use button of said remote control device, said multi-use button having a single closure position; and means for presenting help information relating to said multi-use button of said remote control device to said user based on a flash activation of said multi-use button to assist said user in using said multi-use button.

16. The apparatus for providing help information to a user of a remote control device based solely on activation of a relevant button according to claim 15, wherein:

said multi-use button corresponds to any one of a plurality of commands at any particular time.

17. The apparatus for providing help information to a user of a remote control device based solely on activation of a relevant button according to claim 16, further comprising:

means for selecting one of a plurality of help phrases for said multi-use button based on a current mode of said remote control device.

18. The apparatus for providing help information to a user of a remote control device based solely on activation of a relevant button according to claim 15, wherein:

said means for presenting help information outputs a spoken phrase selected from a database of possible phrases for each multi-use button.

19. The apparatus for providing help information to a user of a remote control device based solely on activation of a relevant button according to claim 15, wherein:

said means for presenting help information includes a display.

* * * * *